US012545374B1

(12) United States Patent
Corris

(10) Patent No.: US 12,545,374 B1
(45) Date of Patent: Feb. 10, 2026

(54) POOL FLOAT TETHER DEVICE

(71) Applicant: Michael Corris, Leesburg, FL (US)

(72) Inventor: Michael Corris, Leesburg, FL (US)

( * ) Notice: Subject to any disclaimer, the term of this patent is extended or adjusted under 35 U.S.C. 154(b) by 453 days.

(21) Appl. No.: 18/323,226

(22) Filed: May 24, 2023

Related U.S. Application Data

(60) Provisional application No. 63/413,235, filed on Oct. 4, 2022.

(51) Int. Cl.
*B63B 34/565* (2020.01)
*A45F 3/15* (2006.01)

(52) U.S. Cl.
CPC ..... *B63B 34/565* (2020.02); *A45F 3/15* (2013.01)

(58) Field of Classification Search
CPC .... B63B 34/565; A45F 3/14; A45F 2003/142; A45F 2003/144; A45F 2003/146; A45F 2003/148; A45F 3/15; A61G 7/1051; F16B 2/08
See application file for complete search history.

(56) References Cited

U.S. PATENT DOCUMENTS 4,790,462 A * 12/1988 Kawaguchi ..... A43B 5/0425 224/616
4,862,563 A * 9/1989 Flynn ..... F16B 2/08 24/442
5,031,639 A * 7/1991 Wolfer ..... A61F 5/3723 128/869
5,136,759 A * 8/1992 Armour, II ..... A45F 3/14 24/442
5,190,194 A * 3/1993 Rosner ..... B63B 34/565 441/131
D357,801 S * 5/1995 Short ..... D3/229
5,460,113 A 10/1995 Gunter
6,553,944 B1 * 4/2003 Allen ..... A01K 27/003 119/770
7,389,750 B1 6/2008 Rogers et al.
(Continued)

*Primary Examiner* — Andrew Polay
(74) *Attorney, Agent, or Firm* — John Rizvi; John Rizvi, P.A.—The Patent Professor ®

(57) ABSTRACT

There is provided herein a pool float tether device. The device can have two identical rectangular straps each having a longitudinal length, two opposing strap surfaces and two opposing longitudinal strap ends. Each strap can have two hook or loop fastener portions, one on each strap surface and which are at opposing strap ends. The hook or loop fastener portions are capable of making a releasable connection therebetween in order to form a loop having an interior loop surface and an exterior loop surface. The two rectangular straps are also permanently bound together at a bonding location; and the straps can each have a buckle connector located on the exterior loop surface of each strap. There is also provided a method of tethering together pool floats which can entail providing two pool floats; making the releasable connection with the opposing hook and loop fasteners of one strap around both of the pool floats to provide a first set of tethered pool floats, tethering two other pool floats together using a second tethering device which is identical with the first tethering device to provide a second set of tether pool floats; and, connecting a buckle connector of the first set of tether pool floats with the corresponding buckle connector on the second set of tethered pool floats.

20 Claims, 6 Drawing Sheets

(56) References Cited

U.S. PATENT DOCUMENTS

| | | | | |
|---|---|---|---|---|
| 8,187,047 | B1 | 5/2012 | Brooks | |
| 8,776,732 | B2 | 7/2014 | Bredesen et al. | |
| 9,278,734 | B2 | 3/2016 | Pennington | |
| 11,241,351 | B1 | 2/2022 | Lang | |
| D1,082,319 | S * | 7/2025 | Lehtonen | A45C 13/20 D3/327 |
| 2005/0184118 | A1* | 8/2005 | Vella | A45F 3/02 224/625 |
| 2006/0107626 | A1* | 5/2006 | Wilson | B68B 1/04 54/44.1 |
| 2008/0010787 | A1 | 1/2008 | Kinskey | |
| 2008/0057805 | A1* | 3/2008 | Alexander | B63B 32/87 441/75 |
| 2008/0127461 | A1* | 6/2008 | Linden | A45F 5/02 24/302 |
| 2011/0312235 | A1 | 12/2011 | Wickham | |
| 2015/0283006 | A1* | 10/2015 | Akins | A61G 1/044 5/628 |
| 2018/0139921 | A1* | 5/2018 | Kath | A01K 1/029 |
| 2020/0339229 | A1* | 10/2020 | Leonard | B63B 34/565 |

* cited by examiner

POOL FLOAT TETHER DEVICE

CROSS-REFERENCE TO RELATED APPLICATIONS

This application claims the benefit of U.S. Provisional Patent Application Ser. No. 63/413,235 filed on Oct. 4, 2022, which is incorporated by reference herein it is entirety.

FIELD OF THE INVENTION

The present invention relates generally to the field of pool recreation. More particularly, the present invention relates generally to pool floats and their use.

BACKGROUND OF THE INVENTION

The ever-increasing amount of work and stress faced by most people due to their busy schedules has increased the demand for time off from work and/or vacations. Often time off of work and/or vacation time involves personal rest and relaxation. One of the most common means of recreation are aquatic activities, such as those that can be enjoyed in the use of a pool. Pool recreation can involve a host of different activities such as swimming, diving, and lounging in the pool.

A popular means of lounging in the pool is to suspend a person on a pool float. Pool floats allow an individual to relax their limbs and expose more of their body to sunlight. A pool float will support the weight of the individual to keep their body above the water. Various pre-made different shaped and sized pool floats are available for purchase.

Some pool floats have round or rectangular shapes which can generally suspend a person on a platform slightly above the surface of the water while still providing close and easy contact with the surrounding water should the person wish to access the water to cool off. Other types of pool floats are designed to be used by a person who only wishes to be partially immersed in the water to a small degree. Some floats which can provide such ancillary water contact are donut shaped floats, chair floats, floating mats, and the like. Finally, there are types of pool floats which permit a person to be mostly immersed in the water. For example, there are clinging type floats such as noodle floats, donut floats which can be worn around the torso, kick boards, and the like.

Whatever type of float is chosen, such floats are usually pre-made and set to specific shapes, sizes, and configurations. Thus, there is little ability to personalize pool floats. While one could use two or more different pool floats at the same time to provide a desired general effect, such provides for tenuous support, and also does not provide for much specificity as to the specific user of the float(s).

In addition, a pool float is formed of either inflatable sections or soft foam materials to provide flotation during use. Inflatable pool floats rely on the shape of inflatable sections to provide support and buoyancy during use, which as stated above, tend to be pre-configured and impersonal. Pool floats made of soft foam materials, such as pool noodles, while being more flexible and conformable in use to a broad array of different sized people, tend to have only one or two possible configurations during use.

Finally, while most people do generally appreciate lounging in a pool using a pool float, some people, such as for example, small children can become easily bored with pool floats in that they do not offer any means of providing additional entertainment or creativity for children besides using them for flotation.

Accordingly, there remains a need for a solution to at least one of the aforementioned problems. For instance, there is an established need for a pool float that can be personalized, and as such there is a need for a means which can provide for the same, which means can preferably exercise creativity and provide for more interactive entertainment for the user with the pool float.

SUMMARY OF THE INVENTION

The present invention can be directed to pool tether for a pool float. The pool tether can bind two or more pool floats together in a set by using hook and loop fasteners (e.g., Velcro®). Then a plurality of the sets of tethered pool floats can then be used as components for building a personalized pool float for a user that can be unique, suitable in shape and size for the user and which provides for entertainment for those building the pool float by offering a limitless amount of design options thereto. Finally, the components of the tethered pool float can be easily and quickly separated and rebuilt.

In a first implementation of the invention there can be provided herein a pool float tether device comprising:

- two identical rectangular straps wherein each rectangular strap can have a longitudinal length, two opposing strap surfaces and two opposing longitudinal strap ends, and wherein
- each strap can have a hook or loop fastener portion on a longitudinal portion of one strap surface which terminates at one strap end, and an opposing hook or loop fastener portion on a longitudinal portion of the opposing strap surface which terminates at the opposing strap end;
- each hook or loop fastener portion being capable of making a releasable connection with the opposing hook or loop fastener portion of the same strap to form a loop having an interior loop surface and an exterior loop surface,
- each of the two rectangular straps being permanently bound together at a bonding location which can be located at an equivalent location along the exterior loop surface of each strap; and,
- a buckle connector located on the exterior loop surface of each strap; each buckle connector being located at an equivalent distance away from the bonding location.

In one aspect of the invention, one of the hook or loop fastener portion of each strap can have a longer longitudinal length that can be longer than the longitudinal length of the opposing hook or loop fastener portion on the same strap.

In another aspect of the invention, one of the buckle connectors located on the exterior loop surface of one strap can be a male buckle connector, and the other buckle connector located on the exterior loop surface of the other strap can be a female buckle connector.

In yet another aspect of the invention, neither of the buckle connectors located on the exterior loop surface of either strap can be oriented to mate with the other buckle connector.

In yet even another aspect of the invention, both of the straps have an identical width throughout their longitudinal lengths, the widths having two opposing edges, and wherein a plane perpendicular to one edge of the width can be parallel to a plane perpendicular to the opposing edge.

In yet one other aspect of the invention the loop formed by each strap can be less than 28 inches in circumference, preferably less than 26, less than 24, and less than 22.

In a second implementation of the invention there can be provided herein a method of tethering pool floats together comprising:

providing a first pool float tether device comprising:

two identical rectangular straps wherein each rectangular strap can have a longitudinal length, two opposing strap surfaces and two opposing longitudinal strap ends, and wherein each strap can have a hook or loop fastener portion on a longitudinal portion of one strap surface which terminates at one strap end, and an opposing hook or loop fastener portion on a longitudinal portion of the opposing strap surface which terminates at the opposing strap end;

each hook or loop fastener portion being capable of making a releasable connection with the opposing hook or loop fastener portion of the same strap to form a loop having an interior loop surface and an exterior loop surface, each of the two rectangular straps being permanently bound together at a bonding location which can be located at an equivalent location along the exterior loop surface of each strap; and, a buckle connector located on the exterior loop surface of each strap; each buckle connector being located at an equivalent distance away from the bonding location;

providing two pool floats, making the releasable connection with the opposing hook and loop fasteners of one strap around one of pool floats;

making the releasable connection with the opposing hook and loop fasteners of the other strap around the other pool float to provide a first set of tethered pool floats;

tethering two other pool floats together using a second tethering device which can be identical with the first tethering device to provide a second set of tether pool floats;

connecting a buckle connector of the first set of tether pool floats with the corresponding buckle connector on the second set of tethered pool floats.

In one aspect of the invention, the pool floats are pool noodle floats.

In another aspect of the invention, the method can further comprise providing additional sets of tethered pool floats in a horizontal row so as to provide a flat raft made up of tethered pool floats.

In yet other aspect of the invention, the method can further comprise providing additional sets of tethered pool floats and forming the sets in a circle so as to provide a circular donut-shaped raft made up of tethered pool floats.

In yet still another aspect of the invention, there can be provided a lounge chair raft made of sets of tethered pool floats tethered by the pool float tethered device described herein.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1 and/or FIG. 3. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
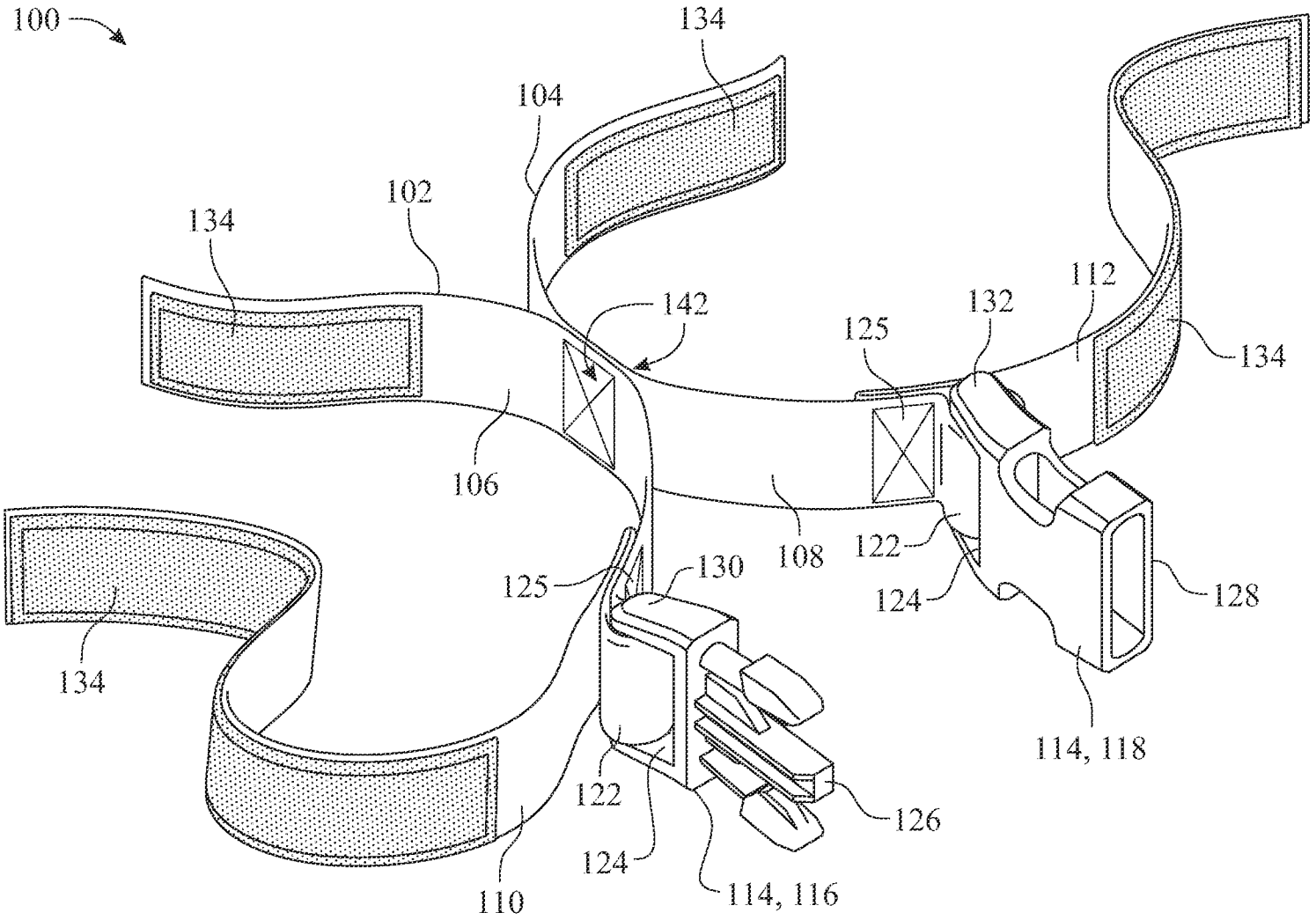
FIG. 1 present a perspective view of the pool float tether device of the present invention.

Referring initially to FIG. 1, there can be provided a pool float tether device 100. The pool float tether device can comprise two separate straps 102 and 104. The straps 102 and 104 can be made of any suitable material, such as, but not limited to leather or polymers such as nylon, polyethylene, polypropylene, polyester, and the like. In some embodiments, the straps 102 and 104 should be approximately 0.5 inches wide to 2 or more inches wide, although some embodiments may accommodate narrower or wider straps. The straps 102 and 104 should be constructed with a thickness ranging from 1/32 of an inch to about 1/4 of an inch. The straps may be of a uniform width and thickness, but it should be understood that straps without a uniform width and/or thickness may also be utilized. Preferably the straps 102 and 104 have a length of from 4 inches up to about 28 inches, preferably from about 6 inches up to about 26 inches, and most preferably from about 8 inches up to about 24 inches.

While each strap 102 and 104 can be of unitary construction, in one preferable embodiment, the straps 102 and 104 can be made up of a plurality of strap parts. For example, as shown in FIG. 1, the straps 102 and 104 can be made up of two parts, a connector strap part 106 and 108, respectively, and a plain strap section 110 and 112 respectively. The strap parts 106 and 110 can be joined together to form the strap 102. The strap parts 108 and 112 can be joined together to form the strap 104. The joining together of parts 106 and 110 and the joining together of parts 108 and 112 can be accomplished by being sewn, stapled, welded or melded together, or using some other technique, to secure the straps parts relative to each other.

Figure 2:
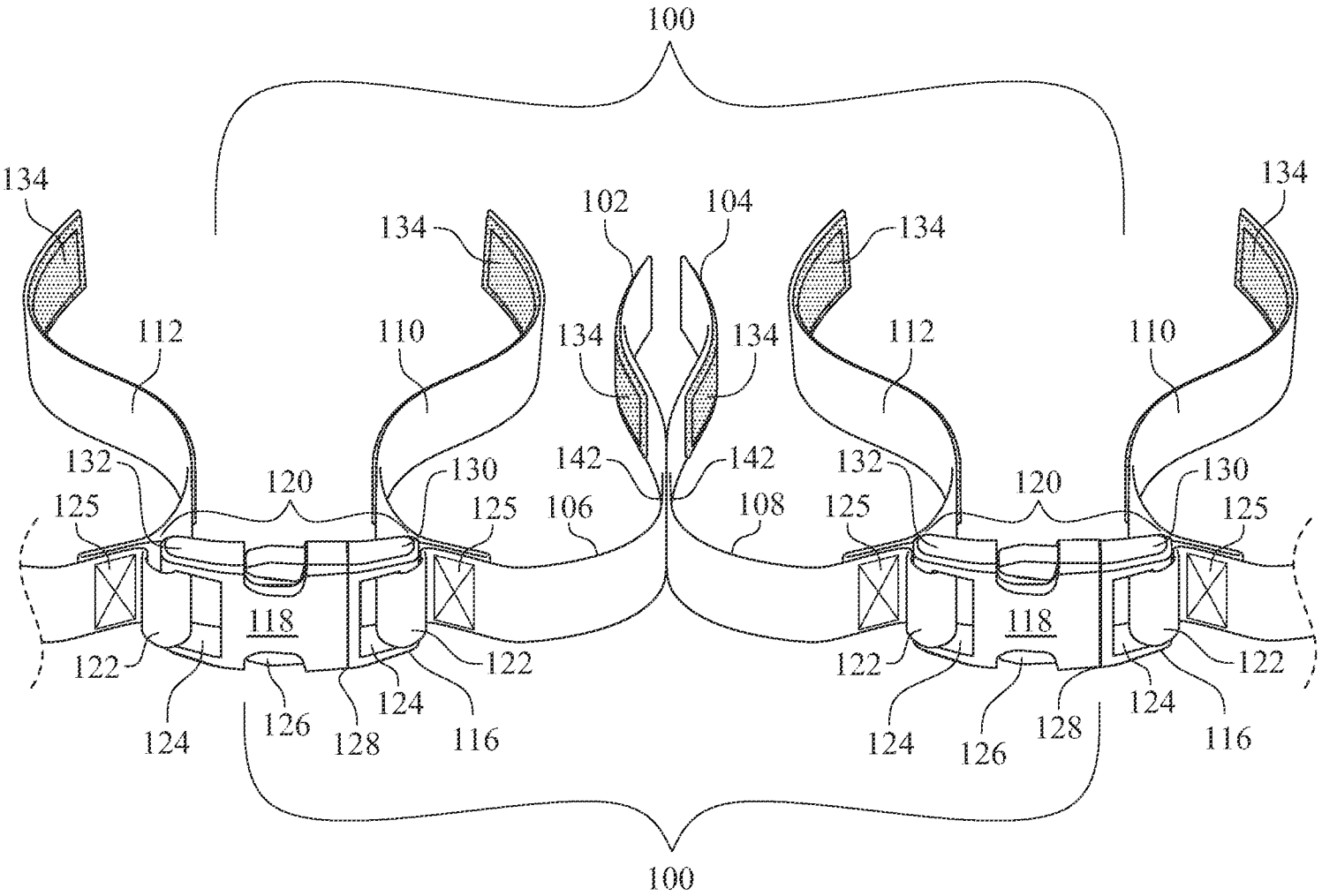
FIG. 2 presents a perspective view of the pool float tether device of FIG. 1 having each belt connector of the pool float tether device shown as being connected to corresponding belt connectors of pool float tether devices partially visible on opposite sides of the pool float tether device.
Figure 3:
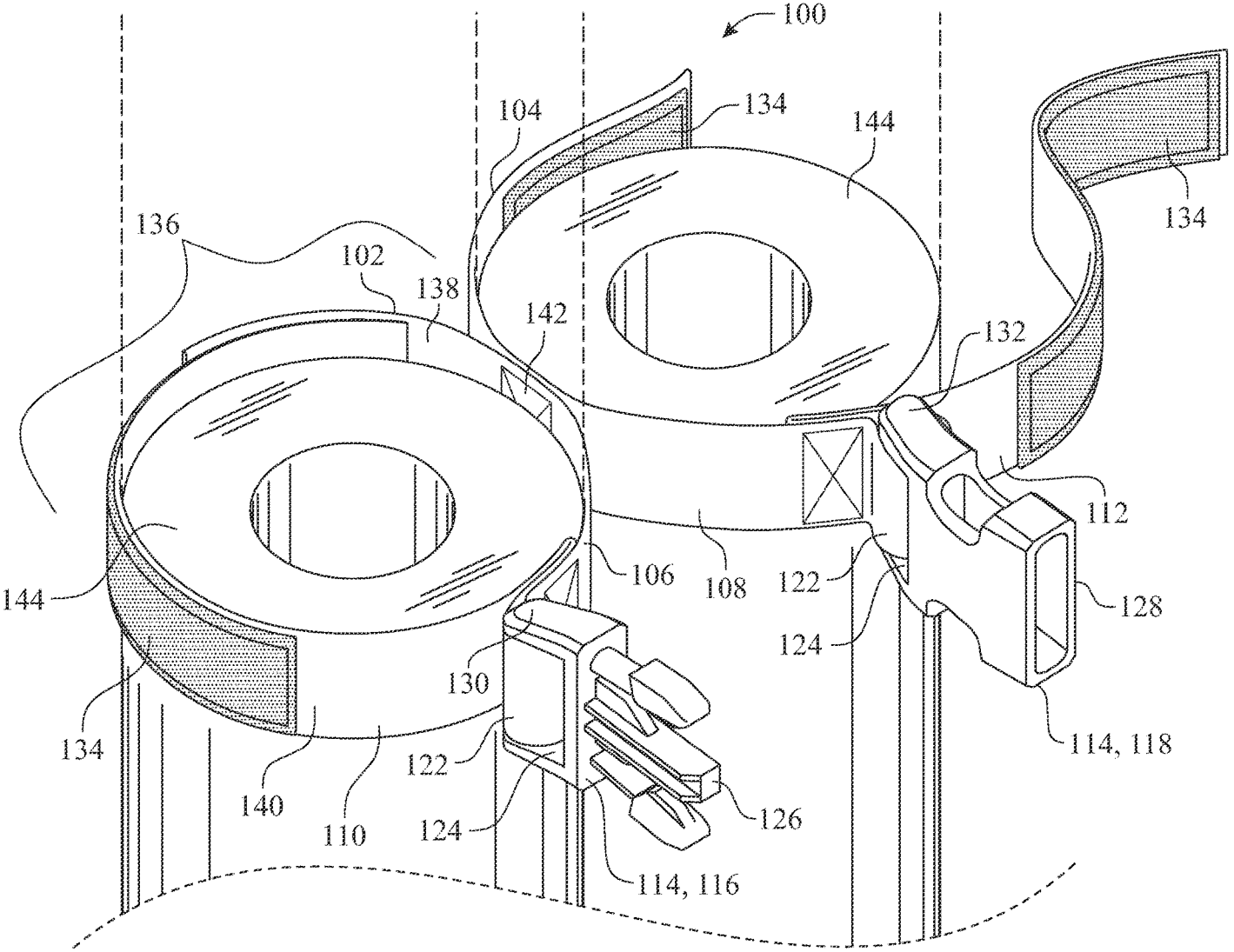
FIG. 3 presents a perspective view of the pool float tether device of FIG. 1 having one strap formed into a loop and the other strap not connected.

Referring now to FIGS. 1-3, the connector straps 106 and 108 can each terminate with a buckle connector 114, preferably a male buckle connector 116 or a female buckle connector 118, each of which can be one half of a male/female connected buckle 120. Preferably, connector strap 106 terminates in a male buckle connector and connector strap 108 terminates in a female buckle connector. Most preferably the male/female connected buckle 120 which can be made up of halves which can be the male buckle connector 116 and the female buckle connector 118 can be a single side adjustable side release buckle such as that shown as the male/female connected buckle 120 in FIG. 2. It can be recognized that the male/female connected buckle 120 can be any other type of buckle such as, but not limited to army-style buckles, slide buckles and cinch buckles.

The male/female connected buckle 120 can be made of any material such as metal or plastic, however, preferably can be made of a polymer material such as polyoxymethylene, nylon, polypropylene, acrylonitrile butadiene styrene, polyvinyl chloride, polyester, thermoplastic rubber and the like. The buckles can have a width which can be about 10% to 20% wider than the width of the straps 102 and 104, preferably from about 0.75 inches to about 2.50 inches, and they can have a length, when connected, of from about 1 inch to about 3 inches.

The buckle connectors 114, 116, 118 can be connected to the respective connector straps 106 and 108 when being manufactured by threading a portion of the respective strap into an opening 124 on a side 130 or 132 of the buckle connector 116, 118, respectively, which sides can be opposite the side of the male part 126 and the side of the female part 128, respectively, of the buckle connector 116, 118 and then sewing, stapling, welding or melding the strap to itself, such as can be seen in buckle sewing location 125, or even more preferably sewing a longitudinal end of the plain part 110, 112 over the looped end 122 of the connector strap part 106, 108. Preferably the buckle connectors 116 and 118 can be oriented in a direction (e.g., curved away from the other connector) other than for interaction with each other, but instead, preferably for interaction with an adjacent connector of an adjacent tethering device 100, such as can be shown in FIG. 2.

Each of the straps 102 and 104 can have a hook or loop fastener portion 134 on a longitudinal portion of one strap surface which terminates at one strap end, and an opposing hook or loop fastener portion on a longitudinal portion of the opposing strap surface which terminates at the opposing strap end. The hook or loop fastener can be one half of a suitable material such as Velcro® and the like as would be known by those of ordinary skill in the art. It will be understood herein in one embodiment that the hook or loop fastener portion 134 and the longitudinal portion of one strap surface can be the same portion. The hook or loop fastener portion 134 on a specific longitudinal portion can be only one of a hook portion or a loop portion.

Thus, for example the hook or loop portion 134 on strap part 106 must have the opposite hook or loop portion 134 on strap portion 110, with the respective hook and loop portions 134 being on opposite sides of the strap 102, such that when they are connected they form a loop; and likewise, the hook or loop portion 134 on strap part 108 must have the opposite hook or loop portion 134 on strap portion 112, with the respective hook and loop portions 134 being on opposite sides of the strap 104, such that when they are connected they form a loop.

Preferably, the hook or loop portion 134 of strap part 106 can be a hook portion 134, and the hook or loop portion 134 of strap part 110 can be a loop portion 134. Likewise, preferably, the hook or loop portion 134 of strap part 108 can be a hook portion 134, and the hook or loop portion 134 of strap part 112 can be a loop portion 134.

The length of the hook or loop fastener portion 134 on the straps 102 and 104 can be the same or of different length. Preferably the lengths can be different with the loop portion 134 being longer than the hook portion 134. More preferably, the hook portion 134 can be a length of from about 1 inch to about 3 inches, and the loop portion 134 can be a length of from about 2 inches to about 5 inches.

The recitation that the hook or loop portion 134 "terminates at the strap end" can be understood to mean that the hook or loop portion comes as close as possible the edge of the longitudinal end of the strap, while leaving some small undetermined area of strap end uncovered by the hook or loop fastener section as to provide for more ready and easy sewing of the hook or loop fastener on the end when the strap is being manufactured. Some such small undetermined area may be from 1 mm up to 10 mm of length of the strap.

Referring to FIGS. 1 and 3, each hook or loop fastener portion 134 can be capable of making a releasable connection with the opposing hook or loop fastener portion 134 of the same strap 102 or 104, and thus, to form a loop, i.e., a tethering loop 136 having an interior loop surface 138 and an exterior loop surface 140. For example, in FIG. 1, the connection of hook fastener portion 134 on strap portion 106 releasably connects with loop fastener 134 on strap portion 110 to form the tethering loop 136 which can be shown in FIG. 3. The expression "releasable connection" can be understood to mean that by normal hand pulling force of the respective straps 102 and 104 having the hook and loop fastener portions 134 connected in the tethered loop 136, the attached hook and loop fastener attachments can be separated from their hook and loop attachment at the respective hook and loop fastener portions 134.

Referring again to FIG. 1, each of the two rectangular straps 102 and 104 can be permanently bound together at a bonding location 142 which can be located at an equivalent location along the exterior loop surface 140 of each strap 102 and 104, such where the bonding location can be an equivalent distance away from the hook or loop portion 134 ends of the straps 102/106 and 104/108. Further, a buckle connector 114, 116, 118 can be located on the exterior loop surface 140 of each strap 102 and 104; each buckle connector 114, 116 being located at an equivalent distance away from the bonding location 142 between the two straps 102 and 104. Referring more specifically to FIGS. 1 and 3, even more preferably, it can be preferred that the hook portion 134 and the buckle connector 116 or 118 be located on opposing sides of the tethering loop 136 when the hook and loop fasteners 134 are connected. Specifically, when the hook portion 134 of strap part 106 can be bound to the loop portion 134 of strap part 110, such forms a tethering loop 136 which can have the buckle connector 116 and the hook portion 134 on opposite sides of the tethering loop 136, such as can be shown in FIG. 3. Likewise, when the hook portion 134 of strap part 108 can be bound to the loop portion 134 of strap part 112, such forms a tethering loop 136, which can have the buckle connector 118 and the hook portion 134 on opposite sides of the tethering loop 136.

Figure 4:
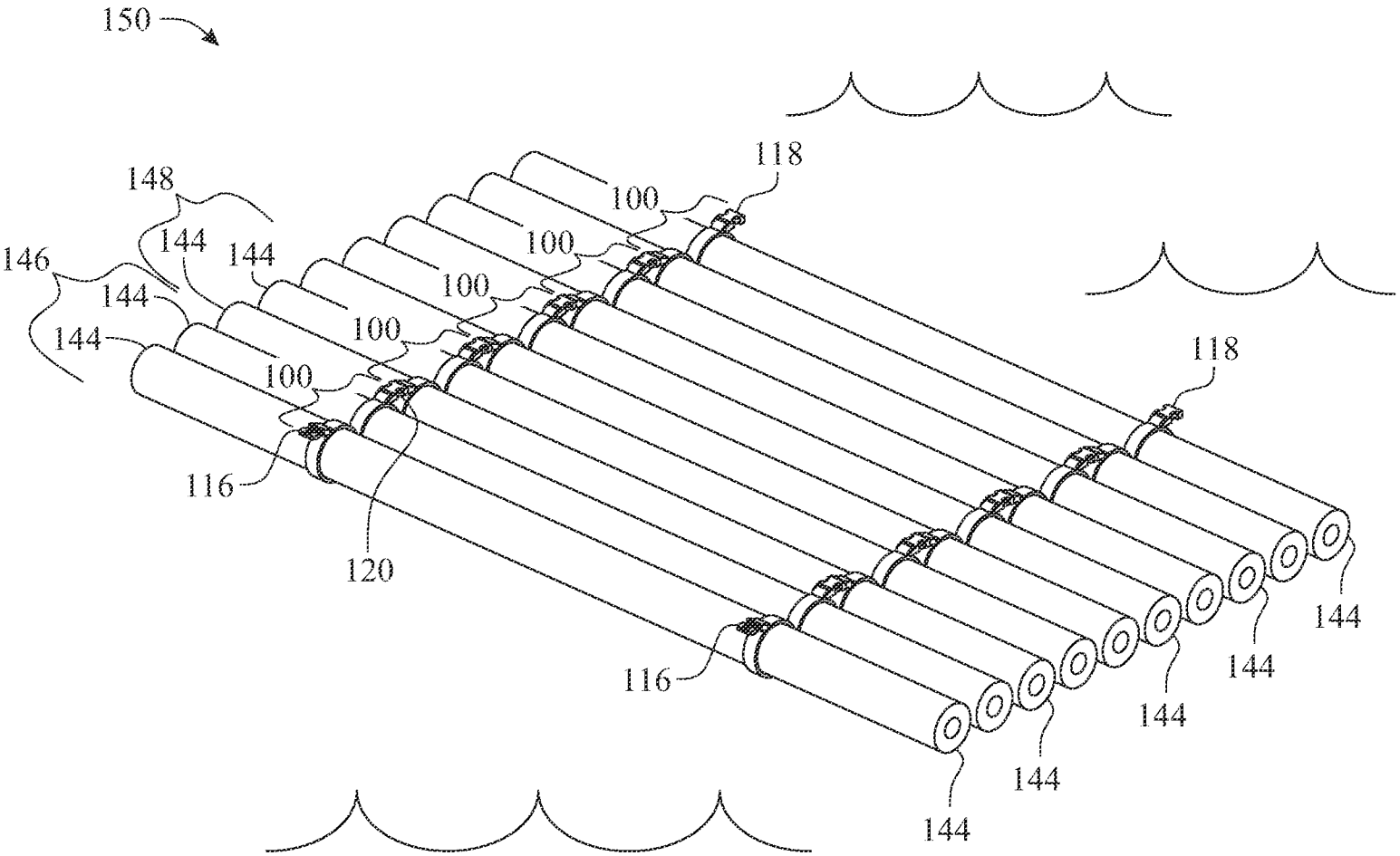
FIG. 4 presents a perspective view of a series of pool float tethered devices of FIG. 1, each pool float tethered device in the series having the straps looped around two adjacent pool floats to form a pair of tether pool floats, the pairs of tethered pool floats joined together by the connectors of the pairs to form a pool float in the shape of a flat raft.
Figure 5:
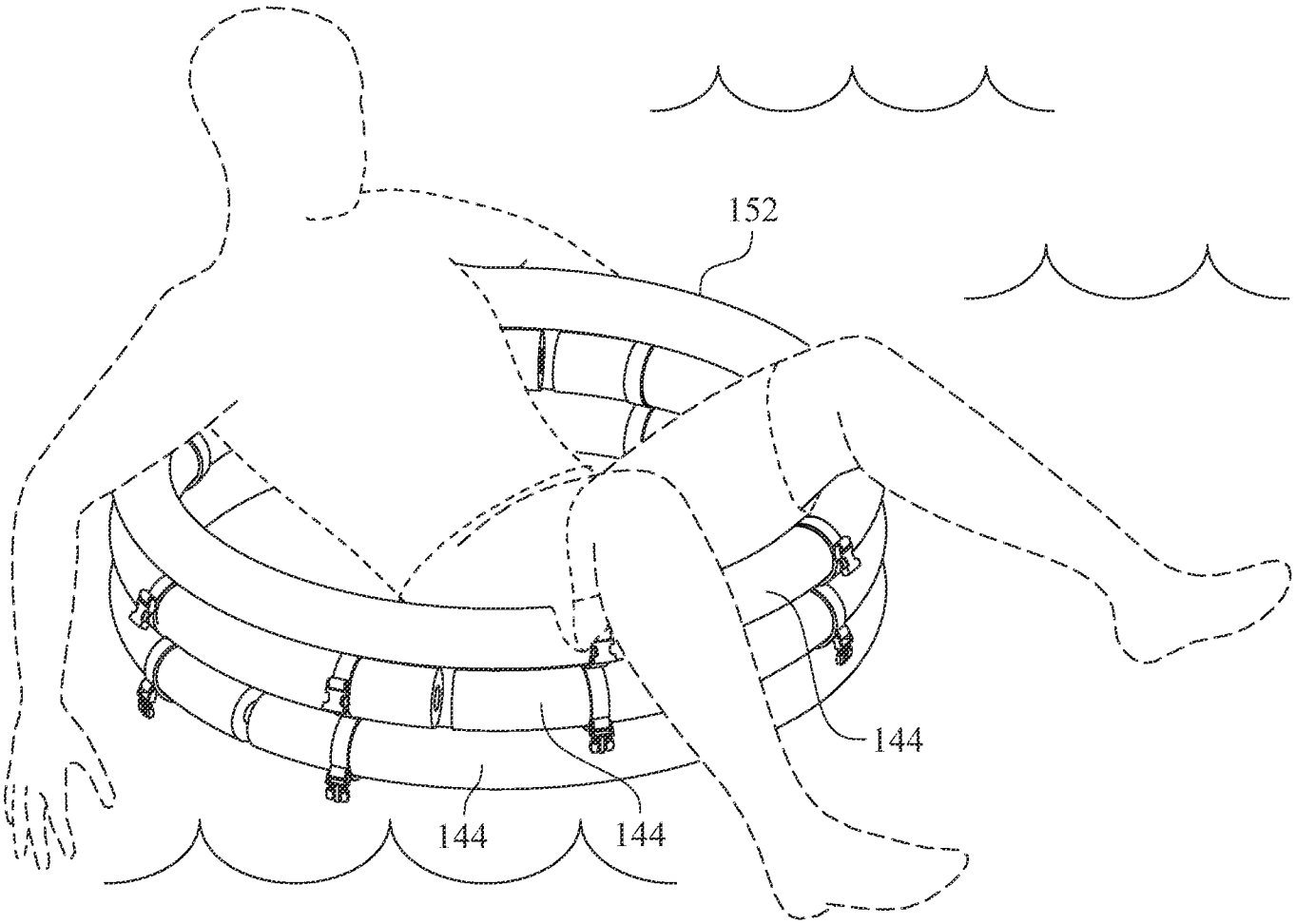
FIG. 5 presents a perspective view of a series of pool float tethered devices of FIG. 1, which straps can be affixed around two adjacent pool floats, but the tethering devices being placed at alternating locations between the first and second, or the second and third, of three noodle floats which can be bent into the shape of a circle, so as to secure the three circles of pool floats together into a donut-shaped raft; and, FIG. 6 presents a perspective view of a series of pool float tethered devices of FIG. 1, set out as the raft of FIG. 4, having tethered thereover a set of bent pool floats tethered together at different points along the pool floats to create a seat back having a hill shape conformation and a seat over the raft section, and tethering around the seat back conformation of pool floats a set of bent pool floats to create an armrest section of tethered pool floats adjacent to the seat and seat back floats.
Figure 6:
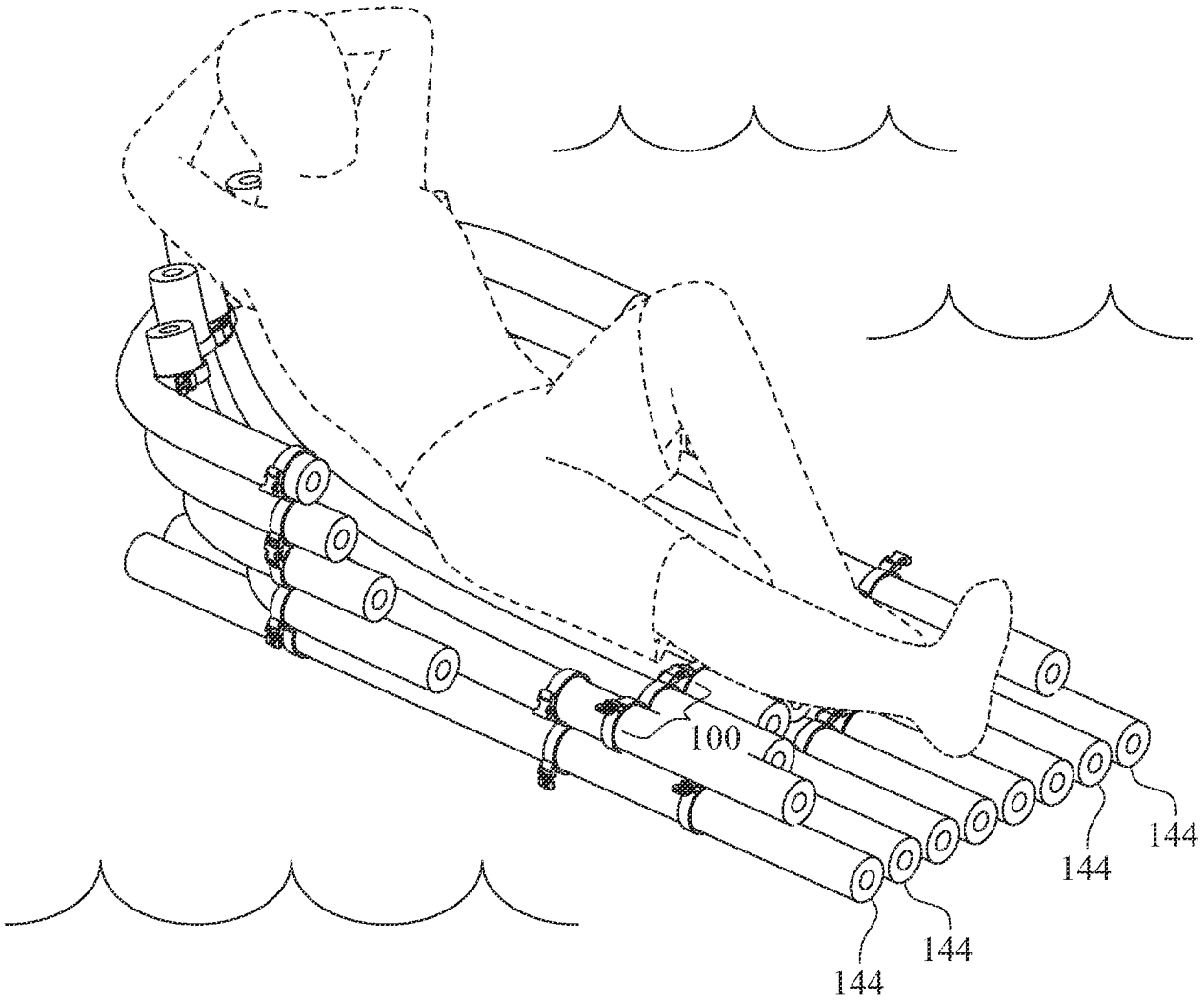

Referring to FIG. 3, the wrapping of the pool float tethering device 100 around two pool noodles 144 can be shown. Referring to FIG. 4 the connection of the tethering device 100 around 2 pool noodles 144 to form a first tethered stet of pool noodles 146, and then the use of a second tethering device 100 to tether two pool noodles 144 together to form a second tethered stet of pool noodles 148 which can be connected by a male/female connected buckle 120. As such, the pool noodle raft 150 can be constructed. Referring to FIG. 5 there can be no connectors 120 present in the circular raft 152 since there can be only three pool noodles 144 being employed. Further to secure the pool noodles 144 to each other and to maintain the circular shape, the device 100 can be placed at certain locations between the first and second pool noodles 144 and at separate locations along the pool noodles 144 between the second and third pool noodles 144. Referring to FIG. 6, there is shown a lounge chair float 154, and such a construction can be made by those skilled in the art employing device 100 as described herein and using the methods described herein.

In one embodiment therein the pool float tether 100 is not for wear by a person or for use in lifesaving equipment to save or carry a person.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A pool float tether device comprising: two identical rectangular straps wherein each rectangular strap has a longitudinal length, two opposing strap surfaces and two opposing longitudinal strap ends, and wherein each strap has a hook and loop fastener portion on a longitudinal portion of one strap surface which terminates at one strap end, and an opposing hook and loop fastener portion on a longitudinal portion of the opposing strap surface which terminates at the opposing strap end; each hook and loop fastener portion being capable of making a releasable connection with the opposing hook and loop fastener portion of the same strap to form a loop having an interior loop surface and an exterior loop surface, each of the two rectangular straps being permanently bound together at a bonding location which is located at an equivalent location along the exterior loop surface of each strap; and, a buckle connector located on the exterior loop surface of each strap; each buckle connector being located at an equivalent distance away from the bonding location.

2. The pool float tether device of claim 1, wherein one of the hook and loop fastener portion of each strap can have a longer longitudinal length that can be longer than the longitudinal length of the opposing hook and loop fastener portion on the same strap.

3. The pool float tether device of claim 1, wherein one of the buckle connectors located on the exterior loop surface of one strap is a male buckle connector, and the other buckle connector located on the exterior loop surface of the other strap is a female buckle connector.

4. The pool float tether device of claim 1, wherein the buckle connectors together make up a side adjustable side release buckle.

5. The pool float tether device of claim 1, wherein the buckle connectors together can be selected from the group consisting of army-style buckles, slide buckles and cinch buckles.

6. The pool float tether device of claim 1, wherein neither of the buckle connectors located on the exterior loop surface of either strap is oriented to mate with the other buckle connector.

7. The pool float tether device of claim 6, wherein each of the buckle connectors located on the exterior look surface of either strap is oriented to make with a buckle connector located on an adjacent pool float tether device.

8. The pool float tether device of claim 1, wherein both of the straps have an identical width throughout their longitudinal lengths, the widths having two opposing edges, and wherein a plane perpendicular to one edge of the width is parallel to a plane perpendicular to the opposing edge.

9. The pool float tether device of claim 1, wherein the straps are each made of a material selected from the group consisting of nylon, polyethylene, polypropylene, polyester and combinations thereof.

10. The pool float tether device of claim 1, wherein the loop formed by each strap is less than 28 inches in circumference.

11. The pool float tether device of claim 1, wherein the straps are bound together by any one of being sewn, stapled, welded or melded together.

12. A pool float tethering system comprising: a pool float tether device which comprises: two identical rectangular straps wherein each rectangular strap has a longitudinal length, two opposing strap surfaces and two opposing longitudinal strap ends, and wherein each strap has a hook and loop fastener portion on a longitudinal portion of one strap surface which terminates at one strap end, and an opposing hook and loop fastener portion on a longitudinal portion of the opposing strap surface which terminates at the opposing strap end; each hook and loop fastener portion being capable of making a releasable connection with the opposing hook and loop fastener portion of the same strap to form a loop having an interior loop surface and an exterior loop surface, each of the two rectangular straps being permanently bound together at a bonding location which is located at an equivalent location along the exterior loop surface of each strap; and, a buckle connector located on the exterior loop surface of each strap; each buckle connector being located at an equivalent distance away from the bonding location; and, at least two pool floats.

13. The system of claim 12, wherein the pool floats are pool noodle floats.

14. A method of tethering pool floats together comprising: providing a first pool float tether device comprising: two identical rectangular straps wherein each rectangular strap has a longitudinal length, two opposing strap surfaces and two opposing longitudinal strap ends, and wherein each strap has a hook and loop fastener portion on a longitudinal portion of one strap surface which terminates at one strap end, and an opposing hook and loop fastener portion on a longitudinal portion of the opposing strap surface which terminates at the opposing strap end; each hook and loop fastener portion being capable of making a releasable connection with the opposing hook and loop fastener portion of the same strap to form a loop having an interior loop surface and an exterior loop surface, each of the two rectangular straps being permanently bound together at a bonding location which is located at an equivalent location along the exterior loop surface of each strap; and, a buckle connector located on the exterior loop surface of each strap; each buckle connector being located at an equivalent distance away from the bonding location; providing two pool floats; making the releasable connection with the opposing hook and loop fasteners of one strap around one of pool floats; making the releasable connection with the opposing hook and loop fasteners of the other strap around the other pool float to provide a first set of tethered pool floats; tethering two other pool floats together using a second tethering device which is identical with the first tethering device to provide a second set of tether pool floats; connecting a buckle connector of the first set of tether pool floats with the corresponding buckle connector on the second set of tethered pool floats.

15. The method of claim 14, wherein the pool floats are pool noodle floats.

16. The method of claim 14, wherein a connection point of the hook and loop portions and the buckle connector are located on opposing sides of the tethering loop when the hook and loop fasteners of are connected.

17. The method of claim 14, wherein the pool floats are formed into a raft.

18. The method of claim 14, wherein the pool floats are formed into a lounge chair raft.

19. The method of claim 14, wherein the pool floats are formed into two raft segments which are connected in angled or perpendicular planes to each other.

20. The method of claim 14, further comprising providing additional sets of tethered pool floats and forming the sets in a circle so as to provide a circular donut-shaped raft made up of tethered pool floats.

* * * * *